United States Patent [19]

Gaudilliere et al.

[11] 3,945,623

[45] Mar. 23, 1976

[54] DEVICE FOR COOLING METAL WIRE

[75] Inventors: Jean-Louis Gaudilliere, L'Argentier-La-Besse; Gilbert Dahan, Villepreux, both of France

[73] Assignee: Aluminum Pechiney, Lyon, France

[22] Filed: Feb. 19, 1975

[21] Appl. No.: 550,975

[30] Foreign Application Priority Data

Feb. 21, 1974 France ..... 75.05878

[52] U.S. Cl. ..... 266/3 R; 118/304; 118/405; 118/420; 134/122 R; 134/199; 148/157; 239/523; 266/65

[51] Int. Cl.[2] ..... C21D 1/64

[58] Field of Search ..... 118/67, 405, 420; 134/64 R, 100, 122 R, 198, 199; 148/157; 239/521, 523; 266/3 R, 6 R, 6 S

[56] References Cited

UNITED STATES PATENTS

| | | | |
|---|---|---|---|
| 2,787,980 | 4/1957 | McDermott | 118/420 X |
| 2,893,409 | 7/1959 | Wulf | 134/122 R |
| 3,237,870 | 3/1966 | McCartney et al. | 239/521 X |
| 3,735,967 | 5/1973 | Brown et al. | 266/3 R |

*Primary Examiner*—Roy Lake
*Assistant Examiner*—Paul A. Bell
*Attorney, Agent, or Firm*—McDougall, Hersh & Scott

[57] ABSTRACT

The invention relates to a machine for cooling metal wire. This machine comprises a cooling tube, an injection device for the cooling fluid and a bypass device for the cooling fluid. The injection device comprises an oblique annular slot fed under high pressure and injectors fed under low pressure. The bypass device comprises an open elbow extending the tube and a second elbow of an opposite curvature terminating in a direction normal in relation to that of the wire. The invention is applied to the cooling of a metal wire, with or without hardening.

5 Claims, 4 Drawing Figures

DEVICE FOR COOLING METAL WIRE

The present invention relates to a machine for cooling metal wire.

A metal wire having a drawplate or a rolling mill generally is at a high temperature. Cooling, amounting to several hundred degrees, must be carried out over a short distance. This cooling may or may not correspond with a hardening operation.

According to prior art, this cooling is accomplished by causing the wire to pass into the axis of a tube traversed by a cooling fluid most frequently in backwash or counter-current flow. However, most frequently, a completely insufficient heat flux is obtained.

The flux to be accomplished, still on the order of several hundred megawatts per square meter, is a function of the diameter and the linear speed of the wire, as well as of the desired cooling velocity.

For example, to cool an aluminum wire 7.5 mm in diameter, traveling by at a speed of 10 meters per second by 200°C per meter, an average heat flux density of 10 megawatts per square meter must be achieved. For a wire 9.5 mm in diameter, traveling at a speed of 5 meters per second, a flux density of 6.5 megawatts per square meter is required.

The objective of the invention is a machine for cooling a metal wire which meets with these requirements.

The machine according to the invention comprises a cooling tube, an injection device for the cooling fluid and a discharge device for the jet of cooling fluid leaving the tube. The injection device includes an oblique annular slot, placed in front of the cooling tube, directed in the direction of the movement of the fluid and fed with cooling fluid under high pressure and at least one cooling fluid injector under low pressure, placed in front of the annular slot. The discharge means assures the bypassing of the cooling fluid jet; it is constituted by an open elbow extension of the cooling tube.

The elbow is preferably extended by a second elbow of opposite curvature and of a smaller radius, whose inner edge is open. Said elbow terminates in a direction normal with that of the metal wire.

The invention thus defined is exemplified by an embodiment illustrated in the attached figures which is given by way of illustration and not by way of limitation:

In these figures identical members are identified by identical reference marks.

Figure 1:
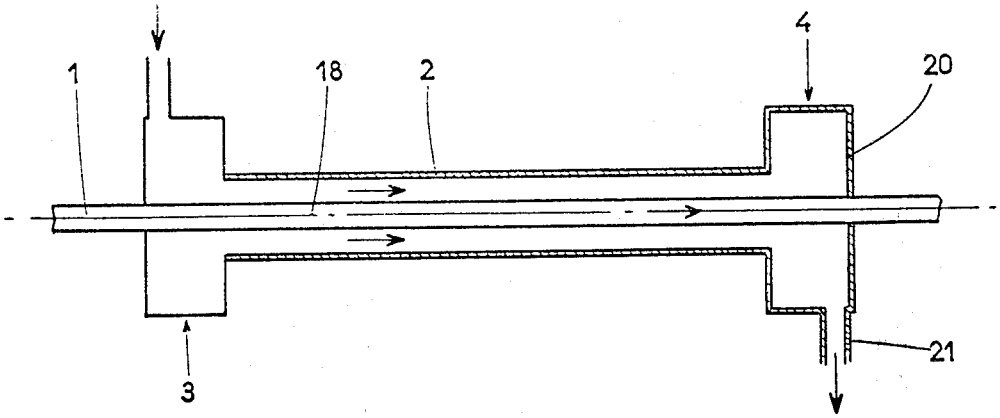
FIG. 1 is a schematic sectional elevational view of the overall machine design, embodying the features of this invention.

In the machine, the principle of which is illustrated in FIG. 1, the wire 1 passes by continuously. In case of a break and if necessary, it must be automatically refeedable. It thus traverses the cooling machine while remaining straight and without having any possibility of encountering a solid obstacle.

The machine comprises three parts: a cooling tube 2, a cooling fluid injection means 3, and a cooling fluid discharge means 4 which assures bypassing the jet of fluid leaving the tube.

The cooling tube 2 is straight; the cooling fluid, generally water, circulates in a current moving in the same direction, that is in the direction of movement of the wire 1 or in counter-current or backwash, that is in the opposite direction. In this tube the essential cooling is effected.

When the surface temperature of the wire is above 200°C, a vapor film forms between it and the water. The heat flux of cooling is, on a first approximation, inversely proportional to the thickness of this film. This thickness is a function of the relative speed of the cooling fluid in relation to the wire, the temperature of this fluid and the distance from the point considered to the point of fluid injection. The density of the flux of evacuated heat is at a very high level at the point of injection and will decrease along the wire.

When the surface temperature of the wire drops below 200° and the cooling fluid is constituted of water, the latter wets the wire. The density of the cooling flux is higher than before and the surface temperature of the wire rapidly decreases to a value proximal to that of the water.

The speed or flow rate of the cooling fluid is calculated on the assumption that the cooling of the wire is only of the first type. The theoretical speed of water in the tube 2 then is a function of the average density of the heat flux to be extracted, the temperature of the water, the length of the tube 2, the diameters of the tube and the wire, the speed of travel of the wire and its direction of movement.

For example, in order to cool by 200°C an aluminum wire 7.5 mm in diameter, moving at 10 meters/second in a tube 25 mm in diameter and 750 mm long with water at 30°C, the relative theoretical speed of the water in relation to the wire is 22 meters/second.

For a wire, 7.5 mm in diameter, moving at 5 meters/-second, the relative theoretical speed is 13.5 meters/-second.

Naturally, it is advisable to add to these speeds that of the wire, depending on whether the latter moves counter-current or in the same direction, in order to obtain the absolute speed of the water in the tube.

In reality, in case of a co-current flow, the speed of the water may be lower than the theoretical value calculated according to the above indications because the very high flux densities of the injection point take place at locations where the wire is hottest.

The diameter of the tube 2 is such that the wire 1 can pass through as freely as possible and so that the passage section for the cooling fluid is sufficient. For example, for wires ranging in diameter between 5 and 12 mm, a tube with an inside diameter of 25 mm is suitable.

Figure 2:
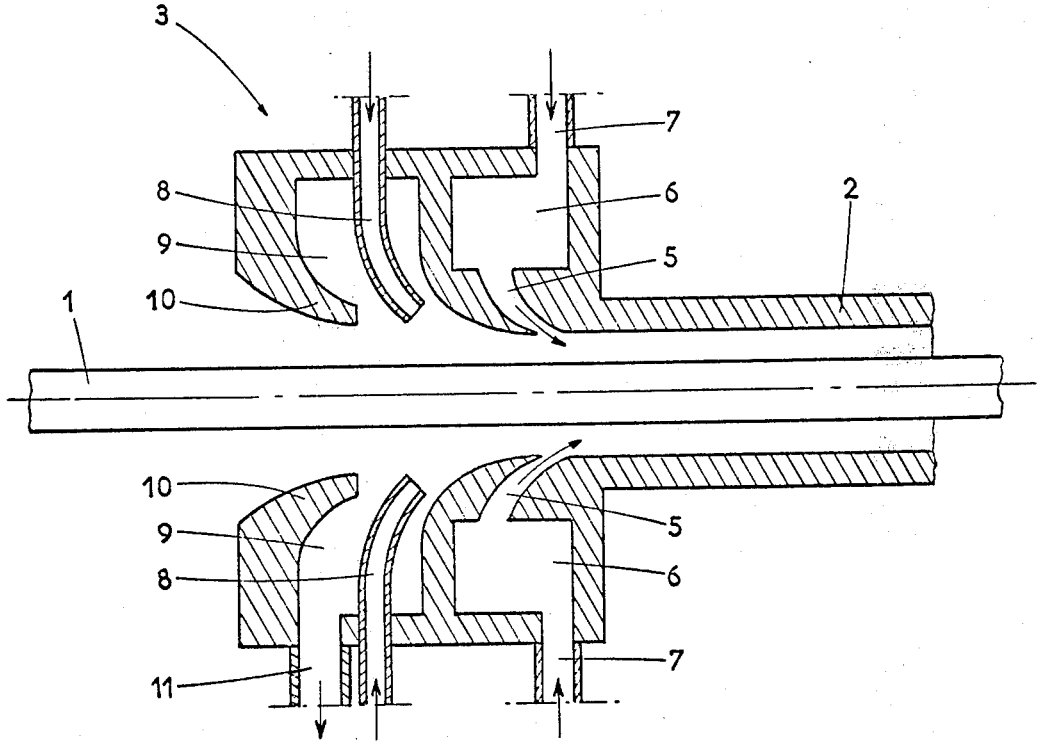
FIG. 2 shows a sectional view of the cooling fluid injection means.

The cooling fluid injection device 3 is represented in FIG. 2. It comprises, ahead of the cooling tube 2, an oblique annular slot 5 directed in the direction of movement of the fluid, its yielding section being smaller than the section of tube 2. This slot 5 is fed by a feed ring 6 connected to one or several conduits 7 which in turn are connected to a source of high pressure cooling fluid. In order to fill the tube, the water must slow down, enabling it to recover part of its dynamic pressure in the form of static pressure intended to overcome the resistance to the outflow from the tube. This injection means acts like a pump which is so set that there is no suction or that there is even delivery. The thickness of the slot 5 and the feed pressure are a function of the speed to be accomplished in the tube and of the resistance to the discharging of the latter. For example, to maintain a speed of 30 meters per second in a tube 25 mm in diameter and 1 meter long, a slot about 3 mm wide and a feed pressure in water of 10 bars are required.

To avoid aspiration of air at the level of the slot 5 and to eliminate any rearward projection of the fluid, cooling fluid is injected ahead of the slot at low speed. For that purpose, fluid injectors 8 are provided ahead of the slot 5, mounted in an annular space 9, limited by an annular lip 10 which does not come in contact with the wire 1. This space 9 is connected to an overflow fluid evacuation tubular system 11. Thus it discharges rearward and can be recovered easily by the tube system 11.

Figure 3:
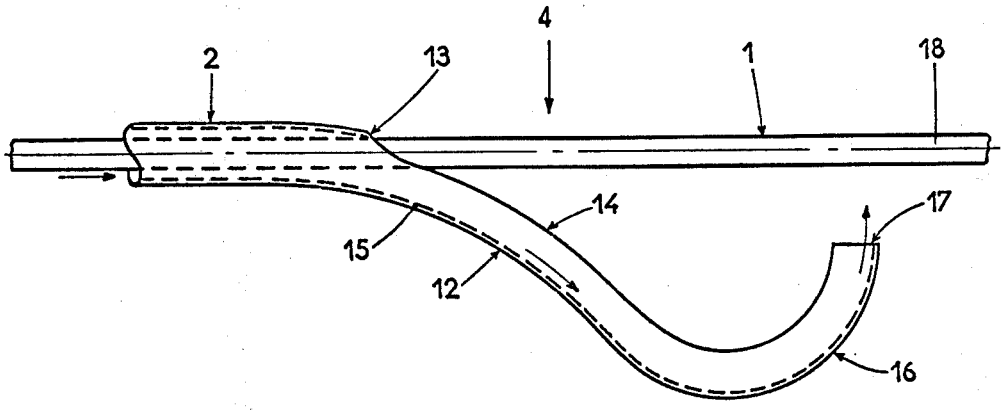
FIG. 3 is an elevational view of the bypass means of the cooling fluid jet.
Figure 4:
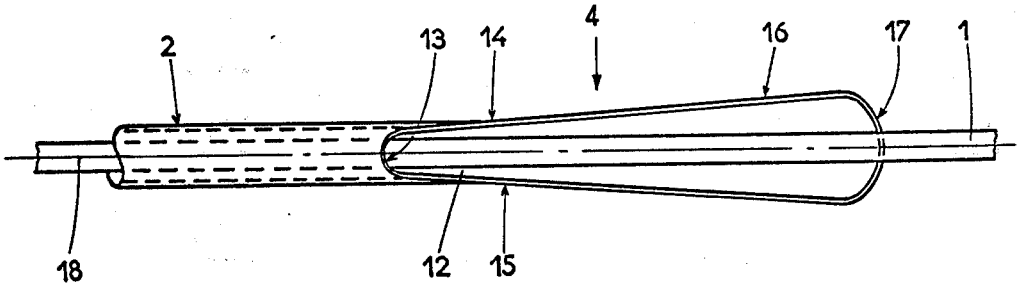
FIG. 4 is a plan view of the bypass of FIG. 3.

The jet bypass means 4 (FIGS. 3 and 4), is constituted by an open elbow 12 which is an extension of the cooling tube 2. The outer edge of this elbow is open at 13, a few centimeters from its start, so as to prime the bypassing of the cooling fluid, and to permit free passage of the wire 1.

The largest part, about 2/3, of the jet issuing from the tube 2 continues to adhere to the inner edge of the elbow 12 and is bypassed normally. Preferably the radius of curvature of this elbow is such that the relation between this radius of curvature and the diameter of the tube is equal to at least 10 and that the difference in static pressure between the outer edge 14 and the inner edge 15 of the elbow is at least equal to 0.5 bar. For example, for a tube 25 mm in diameter and a water speed of 30 meters/second, the radius of curvature of the elbow is at least 400 mm. At lower radii there is a danger of separation. The bending radius should be constant over the entire length of the elbow 12.

However, part of the volume of the cooling fluid, about 1/3 in the preceding example, continues with the wire. To intercept this fluid, the elbow 12 is extended by a second elbow 16 of reversed curvature and of a much smaller radius of curvature (preferably about 1/4), than the radius of the first one, and its end is open. This second elbow 16 redirects the fluid jet diverted by the first elbow so as to project it normal with regard to the wire, enabling it to intercept the fluid which continued to follow the wire. The end 17 of the second elbow is clearly outside the axis 18 of the wire, even though the diverting or bypass means does not constitute any obstacle to the passage of this wire. To avoid the lateral projections of the fluid and to improve the interception of the undiverted fluid, it is advantageous to provide both elbows with side walls arranged on the flanks of the device and formed by two protection plates whose dimensions are slightly larger than those of the assembly formed by the wire 1 and the tube 2.

The assembly of the two elbows 12 and 16 is enclosed in a housing 20 welded to the tube 2 and provided with a fluid discharge tubing 21.

It will be understood that the invention applies to cooling, with or without hardening, of a hot metal wire.

We claim:

1. A machine for cooling metal wire, comprising a cooling tube, an injection means for the introduction of cooling fluid into the tube and a discharge means for the cooling fluid jet leaving the tube, characterized by the fact that on the one hand the injection device includes, in advance of the cooling tube, an oblique annular slot, directed in the direction of the movement of the fluid, means for feeding cooling fluid under high pressure through the slot and into the tube and at least one cooling fluid injector in advance of the annular slot, and means for feeding cooling fluid at low pressure into said injector, and the discharge means is constituted of a curvilinear open elbow extending the cooling tube.

2. A machine according to claim 1, characterized by the fact that the open elbow is extended by a second elbow of opposite curvature and of a smaller curvature radius, with the open end of the second elbow terminating in a direction normal with that of the metal wire.

3. A machine according to claim 1, characterized by the fact that the relation between the radius of curvature of the elbow and the diameter of the tube is at least equal to 10.

4. A machine according to claim 1, characterized by the fact that the difference in static pressure between the outer edge and the inner edge of the elbow is at least equal to 0.5 bar.

5. A machine according to claim 2, characterized by the fact that the ratio of the radius of curvature of the first elbow and the second elbow is about 4.

* * * * *